US006923151B2

(12) United States Patent
Kreuter

(10) Patent No.: US 6,923,151 B2
(45) Date of Patent: Aug. 2, 2005

(54) APPARATUS FOR THE ADJUSTMENT OF THE STROKE OF A VALVE ACTUATED BY A CAMSHAFT

(75) Inventor: Peter Kreuter, Aachen (DE)

(73) Assignee: Meta Motoren-und Energie-Technik GmbH (DE)

( * ) Notice: Subject to any disclaimer, the term of this patent is extended or adjusted under 35 U.S.C. 154(b) by 0 days.

(21) Appl. No.: 10/434,674

(22) Filed: May 9, 2003

(65) Prior Publication Data

US 2003/0209216 A1 Nov. 13, 2003

(30) Foreign Application Priority Data

May 10, 2002 (DE) ..... 102 20 904

(51) Int. Cl.[7] ..... F01L 1/34
(52) U.S. Cl. ..... 123/90.16; 123/90.15; 123/90.39
(58) Field of Search ..... 123/90.12, 90.15–90.17, 123/90.39–90.47

(56) References Cited

U.S. PATENT DOCUMENTS

| | | | | |
|---|---|---|---|---|
| 4,203,397 A | | 5/1980 | Soeters | |
| 4,844,023 A | | 7/1989 | Konno et al. | |
| 5,544,626 A | * | 8/1996 | Diggs et al. | 123/90.16 |
| 5,577,469 A | | 11/1996 | Müller et al. | |
| 5,655,488 A | | 8/1997 | Hampton et al. | |
| 5,697,333 A | | 12/1997 | Church et al. | |
| 5,960,755 A | | 10/1999 | Diggs et al. | |
| 2002/0124820 A1 | * | 9/2002 | Kreuter | 123/90.16 |
| 2003/0200947 A1 | * | 10/2003 | Harris | 123/90.43 |

FOREIGN PATENT DOCUMENTS

| | | |
|---|---|---|
| DE | 41 18 287 | 12/1992 |
| DE | 42 13 855 | 10/1993 |
| DE | 196 52 765 | 6/1997 |

* cited by examiner

*Primary Examiner*—Thomas Denion
*Assistant Examiner*—Jaime Corrigan
(74) *Attorney, Agent, or Firm*—Robert W Becker & Associates; Robert W Becker

(57) ABSTRACT

An apparatus for adjusting the stroke of a valve that is actuated by a camshaft having at least one cam is provided. A valve lever having an outer lever and an inner lever is provided and has a first end region supported on a fixed component, and a second end region for actuating a valve. The U-shaped outer lever includes two arms and a cross-piece that faces the fixed component. At least one of the arms is provided with an abutment surface for contacting the at least one cam. The inner lever is mounted on a free end of the outer lever between the arms, and has an abutment surface, for contacting cams, that is disposed between the mounting axis of the inner lever on the arms and the support of the first end region of the valve lever on the fixed component. A blocking device is provided for fixing the crosspiece of the outer lever on an end of the inner lever remote from the valve, this end being supported on the fixed component and containing the blocking device.

25 Claims, 6 Drawing Sheets

APPARATUS FOR THE ADJUSTMENT OF THE STROKE OF A VALVE ACTUATED BY A CAMSHAFT

BACKGROUND OF THE INVENTION

The present invention relates to an apparatus for the adjustment of the stroke or lift of a valve actuated by a camshaft.

Apparatus for the adjustment of the stroke of charge changing valves of internal combustion engines offer great advantages for numerous applications. For example, by reducing the stroke in the partial throttle range the mixture preparation can be improved, thereby reducing consumption and the content of noxious material in the exhaust gas.

An apparatus of this type is know from U.S. Pat. No. 4,203,397. With this apparatus, the entire U-shaped outer lever is supported on a hydraulic play-compensating element. The inner lever is mounted at the free end of the arms of the outer lever. A blocking device for blocking the pivotability of the inner lever relative to the outer lever is provided with a pivot element that is mounted on the arms of the outer lever adjacent to the free end region of the inner lever; by means of a stationary electro magnet, the pivot element is pivotable into the path of movement of the inner lever, thereby blocking the pivotability of the inner lever relative to the outer lever. The camshaft has a full stroke cam that cooperates with a contact surface of the inner lever, and partial stroke cams that are disposed on both sides of the full stroke cam and cooperate with contact surfaces of the outer lever. The construction of the blocking mechanism is relatively complicated. Furthermore, the outer lever is a relatively complicated, space-consuming and heavy component due to its support upon the valve play-compensating element and the mounting not only of the inner lever but also of the blocking element on the outer lever.

U.S. Pat. No. 5,544,626 discloses a valve disengagement device that has a two-part valve lever, whereby an outer lever has an overall U-shaped configuration and is supported via its crosspiece on a hydraulic valve play-compensating element. Mounted on the ends of the arms of the U is an inner lever that carries a roller for contacting a cam of the camshaft. The free end of the inner lever can be interlocked on the crosspiece of the outer lever in that a pin, which is movably guided in the crosspiece of the outer lever, is moved into a recess formed on the inner lever by means of hydraulic fluid pressure that acts from the hydraulic valve play-compensating element. When the blocking device is arrested, the valve lever acts like a one-part lever that transfers the cam stroke to the valve. When the blocking device is released, the inner lever extends into the outer lever, so that the valve is not actuated.

U.S. Pat. No. 5,655,488 describes an apparatus for the adjustment of the stroke of a valve, which is actuated by a camshaft, via an inner lever that is mounted within an outer lever in the region of the support of the outer lever against a component that is secured to the engine. By means of a blocking device, which displaces a blocking component disposed on that end of the outer lever that is on the valve side, the pivotability of the inner lever relative to the outer lever can be blocked.

It is an object of the present invention to provide an apparatus for the adjustment of the stroke of a valve that is actuated by a camshaft, wherein the apparatus has a straightforward construction and requires little installation space.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

The apparatus of the present invention comprises a valve lever that includes an outer lever and an inner lever and has a first end region that is supported on a fixed component, and a second end region for actuating a valve, wherein the outer lever has an overall U-shaped configuration including two arms and a crosspiece that interconnects the arms and faces the fixed component, wherein at least one of the arms is provided with an abutment surface for contacting the cam or cams of the camshaft, wherein the inner lever is mounted on a free end of the outer lever between the arms thereof, wherein the inner lever has an abutment surface for contacting the cam or cams, and wherein the abutment surface is disposed between the axis of the mounting of the inner lever on the arms of the outer lever and the support of the first end region of the valve lever on the fixed component; and a blocking device for fixing the crosspiece of the lever on an end of the inner lever that is remote from the valve, wherein such end is supported on the fixed component and contains the blocking device.

Due to the fact that the free end of the inner lever is supported on the fixed component, the inner lever can essentially be designed like a conventional valve lever for valves that have no stroke adjustment device. The outer lever can be produced as a simple sheet metal part that spans the inner lever and is mounted on that end of the inner lever that is on the side of the valve.

The apparatus of the present invention can be utilized anywhere where it is advantageous to vary the stroke of a valve that is controlled by a camshaft via a valve lever. The present invention is particularly advantageous for use with intake valves of reciprocating piston internal combustion engines.

Further specific features of the present invention will be described in detail subsequently.

DESCRIPTION OF PREFERRED EMBODIMENTS

Figure 1:
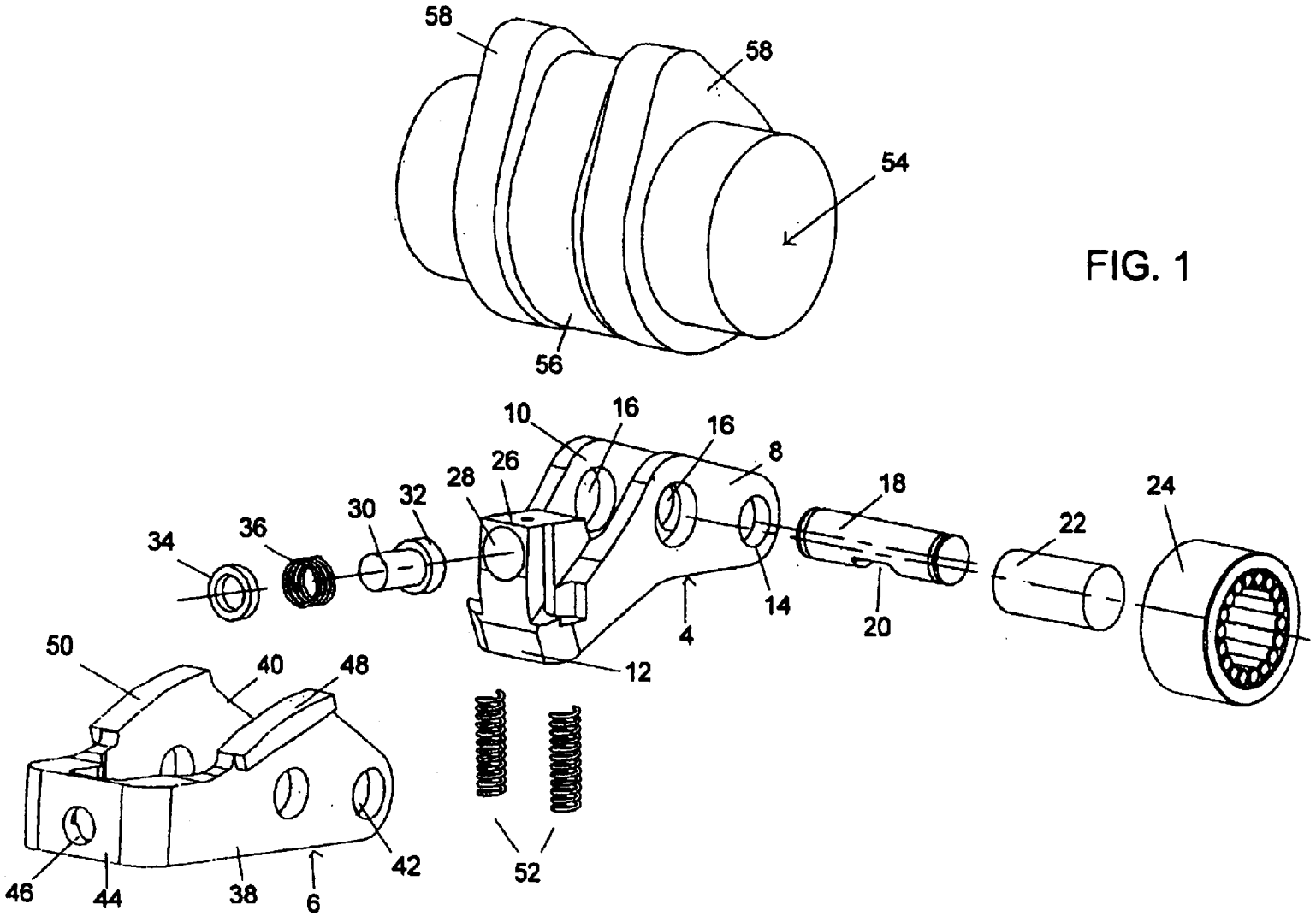
FIG. 1 is a perspective, exploded view of one exemplary embodiment of an inventive apparatus.

Referring now to the drawings in detail, pursuant to FIG. 1 an inventive apparatus for the adjustment of the stroke of a valve that is actuated by a camshaft has a valve lever that is composed of an inner lever 4 and an outer lever 6.

The inner lever 4, when viewed in plan, has an overall U-shaped configuration and contains two curved arms 8 and 10, which are connected via a crosspiece 12. The arms 8 and 10 have two pairs of holes 14 and 16 that are disposed across from one another, whereby a pin 18 can be inserted into the pair of holes 14; this pin 18 is provided with a flat portion 20 for resting against a valve shaft that is not illustrated in FIG. 1. In the installed state, the pin 18 projects laterally out of the arms 8 and 10.

A pin 22 can be inserted into the pair of holes 16 for the mounting of a cam roller 24 that can be inserted between the arms 8 and 10.

The crosspiece 12 has a body 26 that contains a blind hole 28 into which can be inserted a piston 32 that has a shaft 30. A threaded ring 34 can be screwed into the blind hole 28 whereby a spring 36 is provided that surrounds the shaft 30 and is supported between the piston 32 and the threaded ring 34.

The front ends of arms 38 and 40 of the on the whole U-shaped outer lever 6 can, via a pair of holes 42, be mounted on the ends of the pin 18 that projects laterally out of the arms 8 and 10 of the inner lever 4. The arms 38 and 40 can be provided with further holes in order to save weight. Provided in the crosspiece 44 of the outer lever 6 is a hole 46 into which the shaft 30 of the piston 32 can be inserted in the assembled state of the inner lever 4 and outer lever 6. The upper sides of the arms 38 and 40 are formed with abutment surfaces 48 and 50. The outer lever 6 can be embodied as a simple sheet metal part that has been bent in a U-shaped manner, whereby the upper sides of the arms 38 and 40 are bent away to form the abutment surfaces 48 and 50.

In the assembled state, springs 52, which are disposed on both sides of the body 26, are supported between the crosspiece 44 of the outer lever 6 and the crosspiece 12 of the inner lever 4. The springs 52 have the tendency to cock the outer lever 6 relative to the inner lever 4 in a clockwise direction in FIG. 1.

The camshaft 54, which is disposed axially parallel to the pin 22, has a partial stroke cam 56 and full stroke cams 58 that are disposed on both sides of the partial stroke cam 56. In the installed state, the partial stroke cam 56 is contacted by the cam roller 24, and the full stroke cams 58 are contacted by the abutment surfaces 48 and 50. The base circles of the cams can have different diameters. The geometrical coordination is preferably such that the cam roller 24 rests against the pertaining cam base circle when the valve is closed, thereby reducing the friction.

Figure 2:
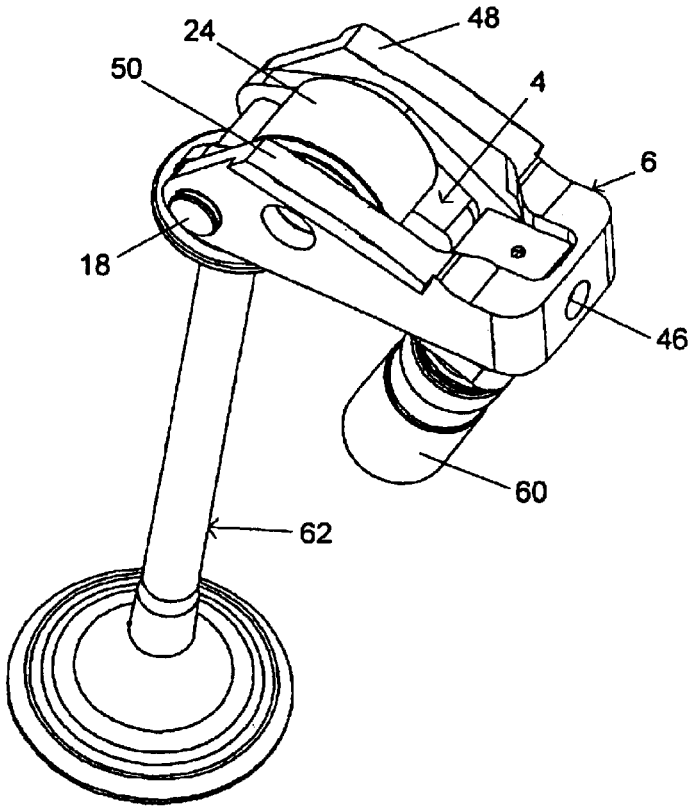
FIG. 2 is a perspective view of the inventive apparatus.
Figure 3:
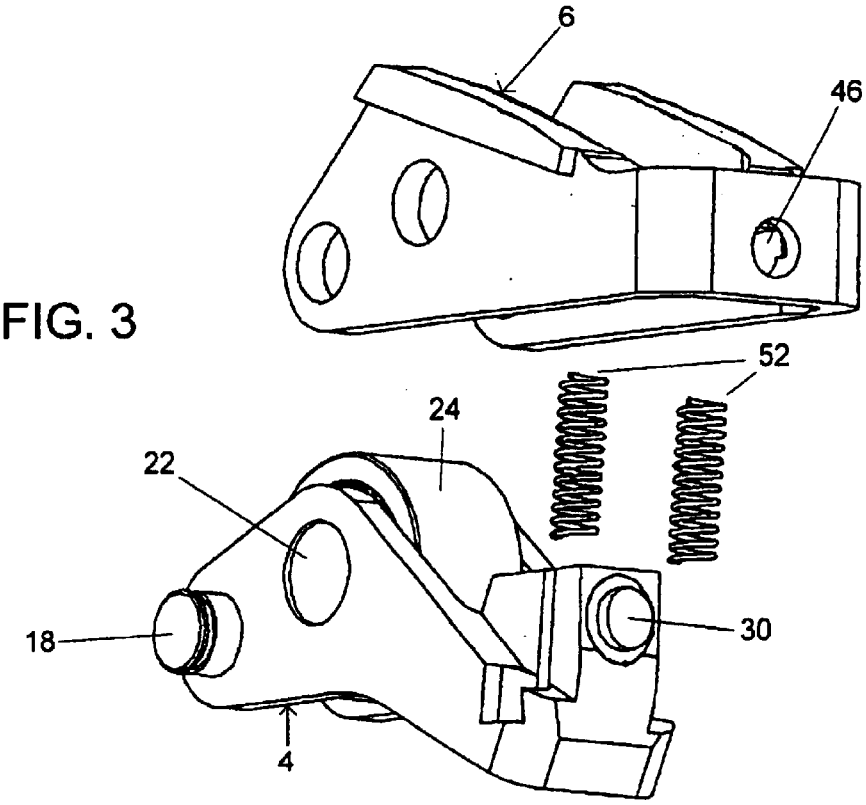
FIG. 3 is an exploded, perspective view of components of the inventive apparatus.

The assembly of the inventive apparatus can also be seen with reference to FIGS. 2 and 3. The cam roller 24 is disposed in the inner lever 4 and is mounted by means of the pin 22. The piston 32 is disposed in the blind hole 28. The spring 36 is placed upon the shaft 30, and the threaded ring 34 is screwed into the blind hole 28. The outer lever 6 is shoved over the inner lever 4 and is secured, so that it can tilt or cock, by inserting the pin 18 into the pair of holes 42 and 14 on the outer lever 6 and inner lever 4 respectively.

Subsequently, the lever assembly is placed via the underside of the crosspiece 12 upon the hydraulic play-compensating element 60 that is secured to the engine housing, and is placed via the flat portion 20 of the pin 18 upon the stem of a valve 62, and the camshaft 54 is installed. Toward the top, the hydraulic play-compensating element 60 is provided with a non-illustrated opening that is aligned with a non-illustrated opening disposed on the underside of the body 26 and communicating via a duct with that end of the blind hole 28 that is disposed on the valve side, so that a pressure chamber is formed between the piston 32 and the base of the blind hole 28. This pressure chamber can be supplied with a lot or little pressure by controlling the pressure that is supplied to the hydraulic play-compensating element and that can be varied via a non-illustrated control device that cooperates with hydraulic valves. When a lot of pressure is supplied to the pressure chamber, the piston moves toward the left in FIG. 1, so that the shaft 30 moves to the outside accompanied by compression of the springs 36 via the threaded ring 34, and when aligned with the hole 46 and the crosspiece 44 of the outer lever 6 penetrates into the hole and blocks the ability of the outer lever 6 to cock relative to the inner lever 4.

Figure 4:
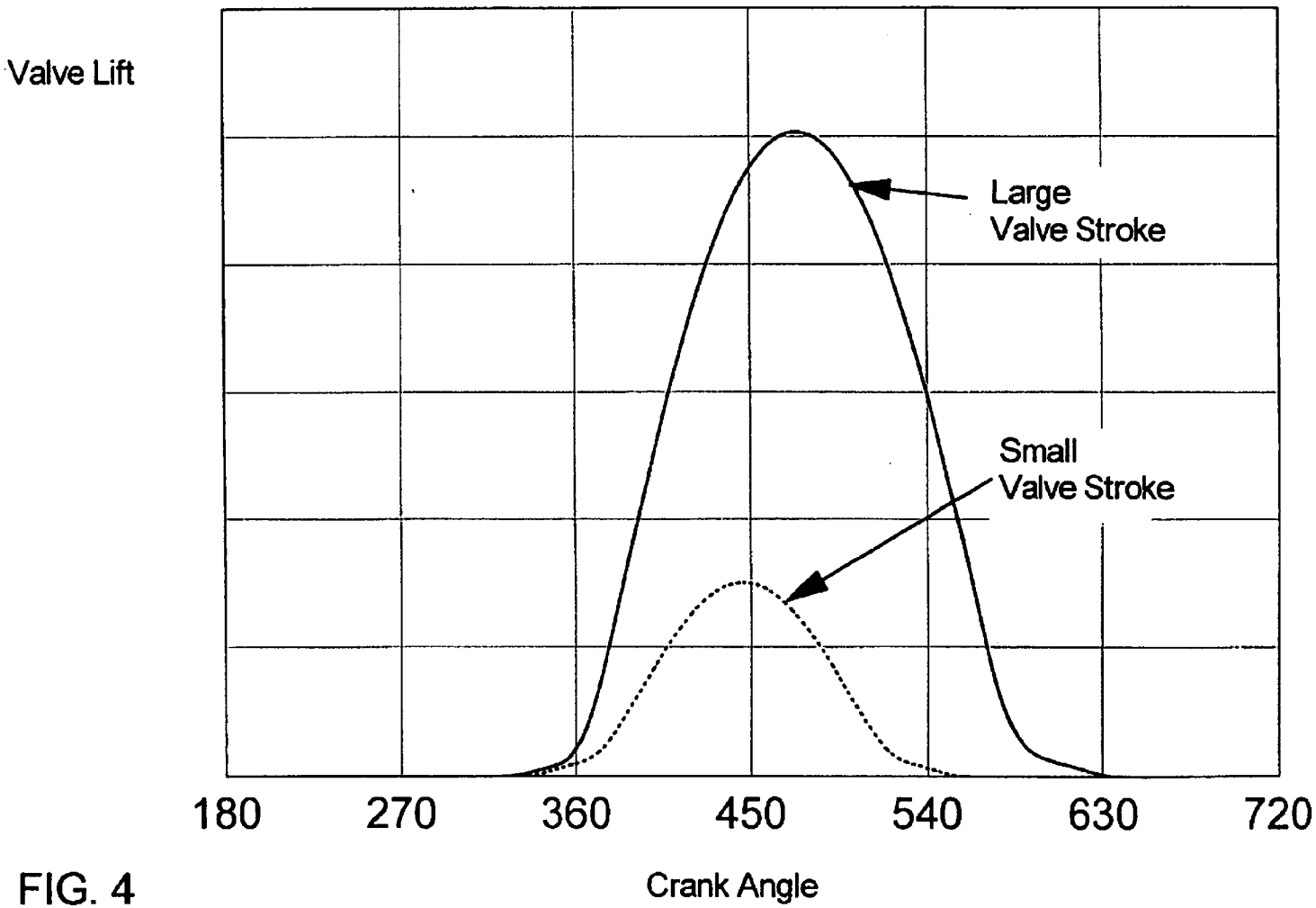
FIG. 4 shows valve stroke curves that can be realized with the inventive apparatus.

The inventive apparatus functions as follows. One first assumes that the pressure chamber is supplied with high pressure, thereby blocking the ability of the outer lever to pivot or cock relative to the inner lever. The base circle of the cam 56, at an appropriate dimensioning of the cam roller 24 and its arrangement relative to the abutment surfaces 48, then rests against the cam roller 24, which leads to a low frictional loss. If the camshaft 54 is rotated further, the full stroke cams 58 project beyond the partial stroke cam 56 and come to rest against the abutment surfaces 48 and 50 of the outer lever, which is locked with the inner lever, so that in conformity with the full stroke cams 58 the valve 62 is opened and a movement is carried out in conformity with the curve labeled "large valve stroke" in FIG. 4.

If, in conformity with operating parameters of the internal combustion engine, a switch is to be made from a large valve stroke to a small valve stroke, the pressure in the play-compensating element 60 is reduced, at least while the base circle of the cam passes over the valve lever, so that the shaft 30 is moved out of the hole 46 by the force of the spring 36, and the outer lever can again pivot relative to the inner layer. If, upon further rotation of the camshaft 54, the full stroke cams 58 now pass over the abutment surface 48, the outer lever is pivoted or cocked relative to the inner lever in a counter clockwise direction in FIG. 1, so that the cam roller 24 remains in contact against the partial stroke cam 56 and the valve is opened in conformity with such partial stroke cam. The curve indicated by dashed lines in FIG. 4 indicates the opening of the valve via the partial stroke cam 56.

The inventive apparatus that has been describesd is extraordinarily compact and, as a result of the very space-saving configuration of the outer lever 6, requires hardly any additional space relative to a conventional cam drive having a one-piece lever. Furthermore, the inventive apparatus is convenient to assemble and is cost efficient. Installation space required for the inner lever 4 corresponds to that of a conventional valve lever. The blocking device integrated into the body 26 requires no additional installation space toward the outside relative to the side facing away from the valve, so that in the direction of the connecting line between valve and mounting of the inner lever, additional space is required only for the thickness of the crosspiece 44. The lever has a symmetrical configuration, so that the same components can be utilized for all valves, even for multi-valve engines. In addition, the arrangement is not exposed to lateral cocking forces.

The inventive apparatus can be modified in a number of ways. For example, the blocking device, which moves only minimally and as a result has little or no disadvantageous effect upon the speed integrity of the valve drive, can be disposed in the inner lever or in a stationary component, and can, for example, be formed by an electromagnet. In the case of the hydraulic actuation of the locking device, a supply of pressure thereto does not necessarily have to be effected by the hydraulic play-compensating element. The cam roller 24 is not mandatory. The inner lever can merely be provided with an abutment surface for the partial stroke cam 56. The outer lever can also be formed with cam rollers.

Figure 5:
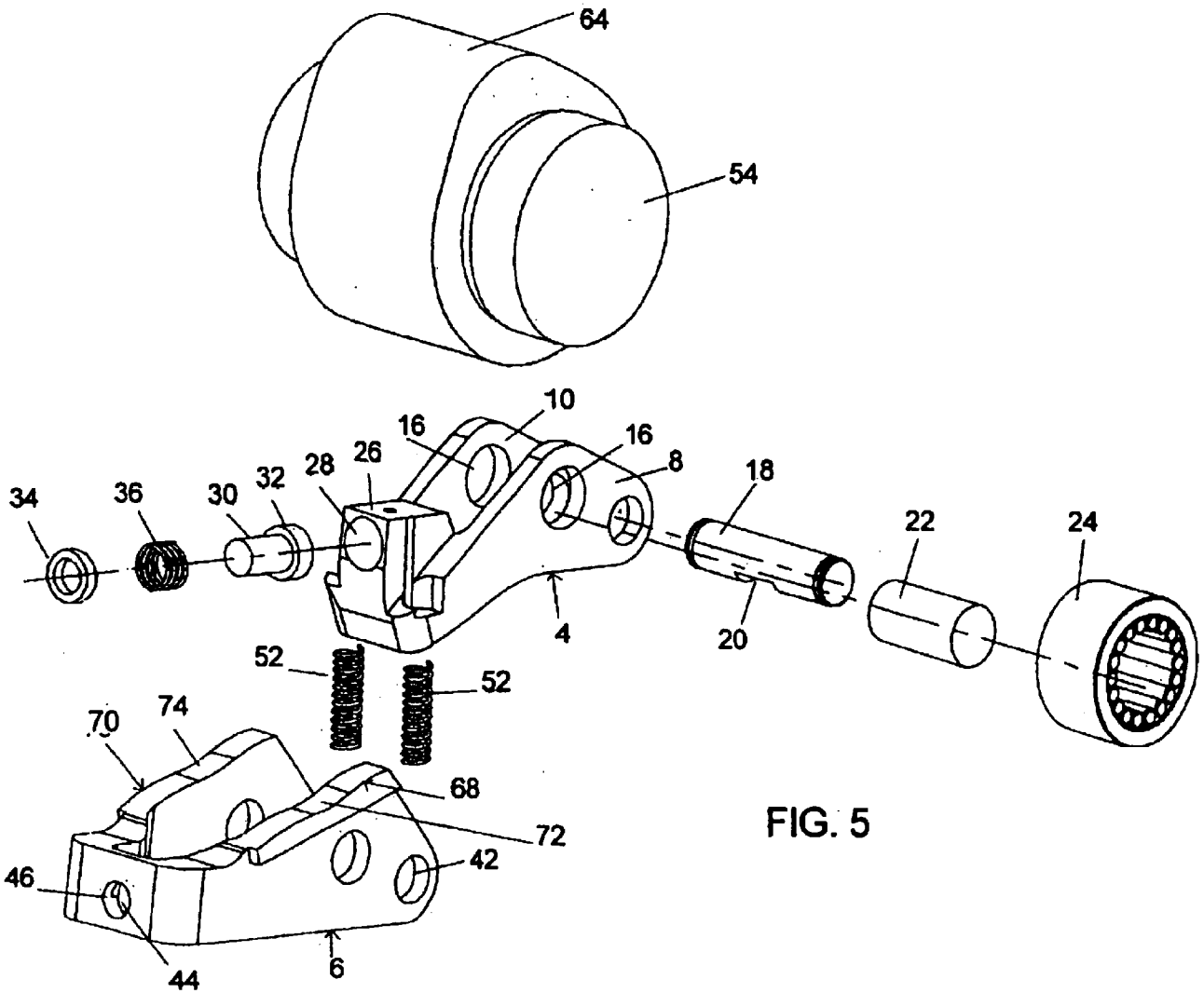
FIG. 5 is a perspective view, similar to that of FIG. 1, of a modified embodiment of a an inventive apparatus.

FIG. 5 shows an embodiment of the inventive apparatus that is modified relative to the embodiment of FIG. 1.

With this embodiment, the camshaft 54 has only a single cam 64 that passes over the outer lever 6 and the inner lever 4. Whereas the abutment surfaces 48 and 50 of the outer lever 6 of the embodiment of FIG. 1 are essentially planar or have a slight crown toward the cam shaft, the abutment surfaces 68 and 70 of the embodiment of FIG. 5 are provided with concave regions 72 and 74, the contour of which corresponds approximately to the contour of the base circle of the cam 64, in other words, has a radius R (see FIG. 6). The cam roller 24 that is mounted in the inner lever 4 is, in the interlocked state between the inner lever and the outer lever, positioned in such a way that its outer contour is approximately lined up with the location A (FIG. 6) at which the concave region 72 or 74, viewed from the mounting location or hole 42 of the outer lever 6, begins. The outer contour of the cam roller 24 can project slightly beyond the location A, thereby ensuring that the cam roller rests against the base circle of the cam.

Figure 6:
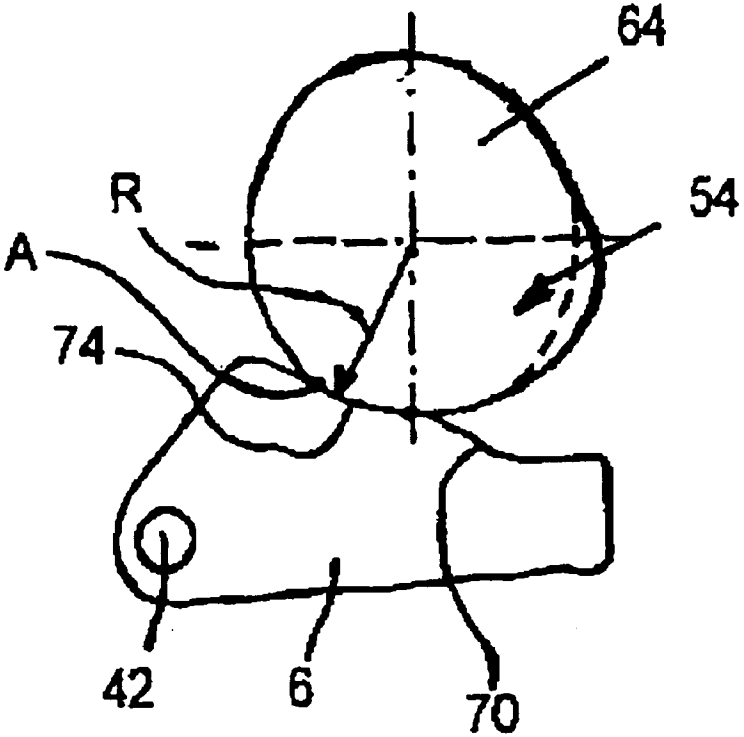
FIG. 6 is a partial side view of the apparatus of FIG. 5.
Figure 8:
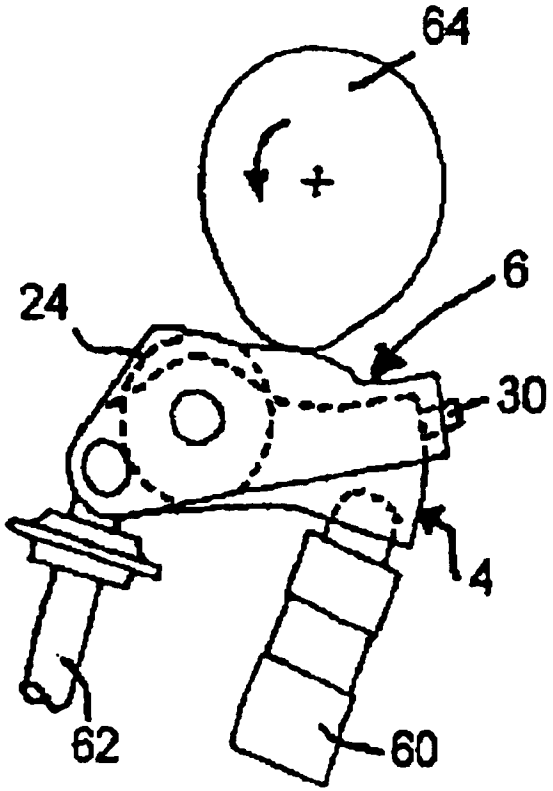
FIGS. 7 & 8 are partial side views of the apparatus of FIG. 5 in different operating positions.
Figure 7:
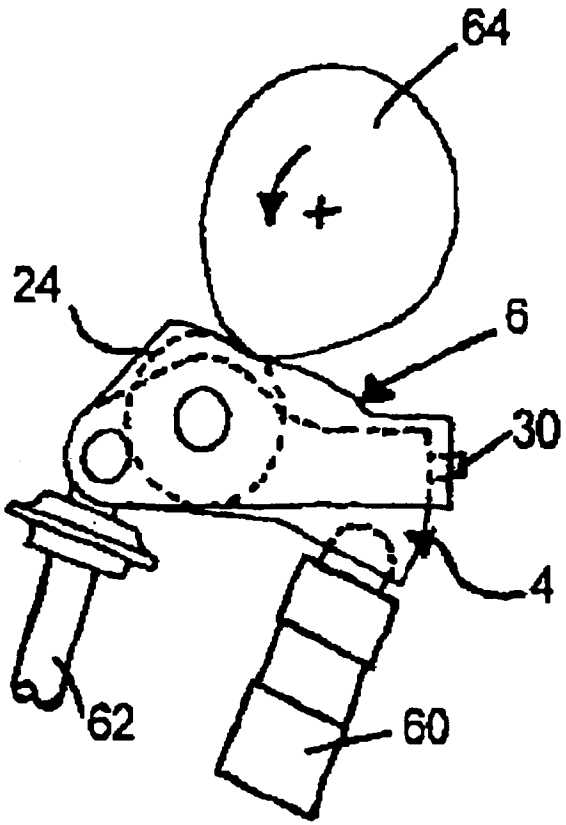

The embodiment of FIGS. 5 and 6 functions as follows. One begins on the assumption that the outer lever and the inner lever are blocked relative to one another. The base circle of the camshaft passes over the concave regions 72 and 74, or rests against the cam roller 24 that minimally extends beyond the introduction into the region (location A). If the cam lobe or elevation now comes into the region of the location A, the cam roller 24 will be pressed away from the axis of the camshaft by the cam lobe, so that the valve is opened somewhat (position shown in FIG. 7). Upon further rotation of the camshaft, the cam lobe becomes free of the cam roller 24, yet remains in contact against the concave regions 72 and 74, as a result of which the outer lever is increasingly pivoted together with the inner lever until the valve is completely opened when the position shown in FIG. 8 is reached where the cam 64 passes over the abutment surfaces 68 and 70 behind the end of the concave region 72 or 74, in other words, the crown of the adjoining convex region. Subsequently, the outer lever and the inner lever are pressed into the closed position by the closure spring of the valve, while maintaining the contact against the cam, until the state shown in FIG. 6 is again reached.

Figure 9:
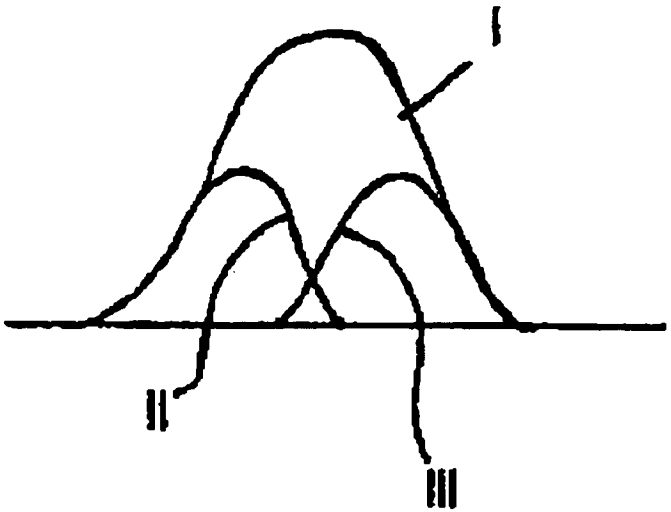
FIG. 9 shows valve stroke curves that can be achieved with the embodiment of FIG. 5

The resulting valve stroke curve corresponds approximately to the curve II in FIG. 9.

If the outer lever 6 is pivotable relative to the inner lever 4, only the cam roller 24 is pressed away during passing over of the cam, whereby the abutment of the cam against the abutment surfaces 68 or 70 effects no further opening of the valve after becoming free of the cam roller 24, so that a valve stroke curve II pursuant to FIG. 9 results that in the starting phase is synchronized with the curve I.

If the direction of rotation of the camshaft 54 is opposite to that illustrated, according to which the cam moves from the location A close to the valve over the concave region 74, there then results, as is readily obligatory, and with the outer lever uncoupled from the inner lever, the valve stroke curve III where the closing side coincides with that of curve I.

The embodiment of FIG. 5, in particular with regard to the installation space that is required, has the same advantages as does the embodiment of FIG. 1, yet requires a simpler camshaft than does the embodiment of FIG. 1.

A further modified embodiment of the inventive apparatus, which is not illustrated in detail, operates with a camshaft having only a single cam similar to the embodiment of FIG. 5, and an outer lever similar to that of the embodiment of FIG. 1. The cam roller 24 of this modified embodiment is, however, formed with a smaller diameter, or due to a different arrangement of the pair of holes 16 in the inner lever 4 is mounted in such a way that its outer surface is recessed relative to the abutment surfaces 68 and 70. In this way, with the pivotability of the outer lever relative to the inner lever being blocked, the abutment surfaces of the outer lever are effective, so that the full stroke of the cam 64 is effective for actuation of the valve 62. When the pivotability of the outer lever 6 relative to the inner lever 4 is released, the outer lever 6 is first pivoted by the cam 64 against the force of the springs 52 in a counter clockwise direction. Subsequently, the cam 64 comes to rest against the cam roller 24 and actuates the valve merely with a stroke that corresponds to the cam lobe minus the stroke that is used up until the cam 64 comes into contact against the cam roller 24. So that the transition of the abutment of the cam 64 from the abutment surfaces of the outer lever to the cam roller is smooth or steady, also with this embodiment the abutment surfaces can have a slightly concave configuration.

It is to be understood that in particular the embodiment of FIG. 5 can also be embodied in such a way that the outer lever 6 is pivotably supported on the hydraulic play-compensating element or some other component, for example the cylinder head, the blocking device is disposed on the crosspiece 44 of the outer lever, and the inner lever is pivotable relative to the outer lever in a counter clockwise direction. The support of the springs 52 is correspondingly different so that the inner lever is pressed upwardly in a clockwise direction. The full stroke transmission is then effected via the inner lever. The partial stroke transmission is effected via the outer lever.

The specification incorporates by reference the disclosure of German priority document 102 20 904.9 filed May 10, 2002.

The present invention is, of course, in no way restricted to the specific disclosure of the specification and drawings, but also encompasses any modifications within the scope of the appended claims.

What is claimed is:

1. An apparatus for adjusting the stroke of a valve, said apparatus comprising:

a camshaft 54 having at least one cam 56, 58; 64;

a valve lever having an outer lever 6 and an inner lever 4, wherein said outer lever 6 has an overall U-shaped configuration including two arms 38, 40, a crosspiece 44 that interconnects said arms and is arranged and constructed to face a fixed component 60 and an open end opposite of the crosspiece 44, the valve lever 6 being arranged and constructed such that said open end is disposed closer to a valve stem of said valve 62 than said crosspiece 44, and wherein at least one of said arms 38, 40 is provided with an abutment surface 48, 50; 68, 70 for contacting said at least one cam 56, 58, 64, wherein a first end region of said inner lever 4 is pivotably mounted at said open end of said outer lever 6, whereby the inner lever 4 extends between said arms 38, 40, a second end region of the inner lever 4 is proximal to said crosspiece 44 and is arranged and constructed to be pivotably supported by said fixed component 60, and said inner lever has an abutment surface 24 for contacting said at least one cam, which abutment surface is disposed between said first and second end regions; and a blocking device 28, 30, 32 arranged and constructed to fix said crosspiece 44 to said second end region of said inner lever 4, wherein said blocking device is disposed in said second end region of said inner lever 4.

2. An apparatus according to claim 1, wherein said end 26 of said inner lever 4 that is remote from said valve 62 is supported on a fixed component 60 that is in the form of a hydraulic play-compensating element, and wherein said blocking device 28, 32 contains a piston/cylinder unit 28, 32 that is actuated via hydraulic fluid pressure derived from said play-compensating element.

3. An apparatus according to claim 2, wherein said blocking device 28, 30, 32 is provided with a blocking pin 30 that can be withdrawn from said inner lever 4 and can be introduced into an opening 46 of said crosspiece 44 of said outer lever 6.

4. An apparatus according to claim 1, further comprising at least one spring 52 disposed between said inner lever 4 and said outer lever 6, wherein said at least one spring 52 is arranged and constructed to displace said outer lever 6 in a direction toward a support defined on said at least one cam 56, 58; 64.

5. An apparatus according to claim 1, wherein said inner lever 4 is provided with two arms 8, 10 that are directed towards said valve 62, wherein a roller 24 is mounted between said arms 8, 10, and wherein said roller forms said abutment surface 24 of said inner lever 4 for contacting said at least one cam 56, 58;64.

6. An apparatus according to claim 5, wherein a pin 18 is disposed on ends of said arms 8, 10 of said inner lever 4, wherein a portion of said pin disposed between said arms of said inner lever is designed for support against said valve 62, and wherein said arms 38, 40 of said outer lever 6 are mounted on portions of said pin 18 that project outwardly beyond said arms 8, 10 of said inner lever 4.

7. An apparatus according to claim 1, wherein said camshaft 54 is provided with a partial stroke cam 56 that is associated with said abutment surface 24 of said inner lever 4, and full stroke cams 58 that are associated with said arms 38, 40 of said outer lever 6.

8. An apparatus according to claim 7, wherein said abutment surface 68, 70 that is provided on at least one of said arms 38 40 of said outer lever 6 has a concave region 72, 74, and wherein said abutment surface 24 of said inner lever 4 is disposed in such a way that, when viewed in an axial direction of said camshaft 54, it coincides approximately with a beginning of said concave region that is near said valve.

9. An apparatus according to claim 1, wherein said abutment surface 24 of said inner lever is disposed in such a way that when said outer lever 6 is fixed on said inner lever 4, said abutment surface is spaced from a surface of said at least one cam.

10. An apparatus comprising:

an outer lever comprising two arms extending substantially in parallel and being interconnected by a crosspiece, the outer lever having a first end portion, a second end portion and at least one first abutment surface defined between the first and second end portions, wherein said at least one first abutment surface is arranged and constructed to contact a camshaft, an inner lever at least partially disposed between the two arms of the outer lever, the inner lever having a first end portion, a second end portion and at at least one second abutment surface defined between the first and second end portions, wherein said at least one second abutment surface is arranged and constructed to contact the camshaft, wherein the respective first end portions of the inner and outer levers are pivotably coupled, at least one of the first end portions is arranged and constructed to contact to a valve stem and at least one of the second portions is arranged and constructed to contact a supporting element, and a locking device disposed substantially within the second end portion of the inner lever and between the arms of the outer lever, the locking device being arranged and constructed to releasably couple the respective second end portions of the inner and outer levers, wherein the inner lever and outer lever are arranged and constructed such that:

(i) the valve stem is actuated by abutment of the camshaft and the outer lever when the locking device couples the respective second end portions, and (ii) the valve stem is actuated by abutment of the camshaft and the inner lever when the locking device releases the respective second end portions.

11. An apparatus according to claim 10, further comprising the supporting element, which comprises a hydraulic play-compensating element.

12. An apparatus according to claim 11, wherein the inner lever comprises two parallel arms and the second abutment surface is defined by a roller mounted between the two arms of the inner lever.

13. An apparatus according to claim 12, further comprising a pin extending through the first end portions of the inner lever and the outer lever, thereby pivotabley coupling the respective first end portions of the inner and outer levers.

14. An apparatus according to claim 13, further comprising the camshaft, which has a full stroke cam that is aligned so as to abut the at least one first abutment surface and a partial stroke cam that is aligned so as to abut the at one least one second abutment surface.

15. An apparatus comprising:

outer lever comprising two arms extending substantially in parallel from a crosspiece, the outer lever having a hinge portion, wherein at least one of the two arms defines a first abutment surface arranged and constructed to contact a camshaft, an inner lever at least partially disposed between the two arms of the outer lever, the inner lever having a supported portion and a hinge portion, the supporting portion being arranged and constructed to be supported by a supporting element, the inner lever also having a second abutment surface arranged and constructed to contact the camshaft, which second abutment surface is disposed substantially adjacent to the first abutment surface, wherein the respective hinge portions of the inner and outer levers are pivotably coupled and the inner and outer, levers are arranged and constructed to connect to a valve stem at a position proximal to the hinge portions, and a locking device disposed substantially within the inner lever and between the arms of the outer lever, the locking device being arranged and constructed to releaseably couple the supported portion and the crosspiece, wherein the inner lever and outer lever are arranged and constructed such that:

(i) the valve stem is actuated by abutment of the camshaft and the first abutment surface when the locking device couples the supported portion to the crosspiece, and (ii) the valve stem is actuated by abutment of the camshaft and the second abutment surface when the locking device releases the crosspiece from the supported portion.

16. An apparatus according to claim 15, further comprising the supporting element, which comprises a hydraulic play-compensating element.

17. An apparatus according to claim 16, wherein the locking device comprises a piston/cylinder unit, which is actuatable by hydraulic fluid pressure supplied from the play-compensating element, and a locking pin that is slidably movable into and out of an opening defined in the crosspiece of the outer lever.

18. An apparatus according to claim 15, further comprising at least one spring disposed between the inner lever and the outer lever, wherein said at least one spring is arranged and constructed to bias the outer lever toward the camshaft.

19. An apparatus according to claim 15, wherein the inner lever comprises two arms that extend towards the valve stem, wherein the second abutment surface is defined by a roller mounted between the two arms of the inner lever.

20. An apparatus according to claim 19, further comprising a pin extending through the arms of the inner lever and the outer lever, thereby pivotably coupling the respective hinge portions of the inner and outer levers.

21. An apparatus according to claim 20, further comprising the camshaft having:

a partial stroke cam that is aligned with the second abutment surface end a full stroke cam that is aligned with the first abutment surface.

22. An apparatus according to claim 21, wherein the first abutment surface comprises a concave groove and the second abutment surface is disposed in such a way that, when viewed in or along the axial direction of the camshaft, the second abutment surface substantially coincides with a portion of the concave region that is nearest to the valve stem.

23. An apparatus according to claim 15, wherein the second abutment surface is disposed in such a way that, when the crosspiece is coupled to the supported portion, the second abutment surface is spaced from the camshaft.

24. An apparatus for changing the stroke length of a valve actuatable by a camshaft having at least a first cam and a second cam, the first cam defining a full stroke length end the second cam defining a partial stroke length, the apparatus comprising:

an outer lever having two arms extending substantially in parallel from a crosspiece, wherein the outer lever also includes a hinge portion arranged and constructed to be coupled to the valve, a first abutment surface is defined on at least one of the arms, and the first abutment surface is arranged and constructed to contact the first cam, an inner lever having a supported portion, which is arranged and constructed to be supported by a hydraulic play-compensating element, and a hinge portion, which is pivotably coupled to the hinge portion of the outer lever, wherein the inner lever is disposed between the two arms of the outer lever, a second abutment surface is defined on the inner lever, end the second abutment surface is arranged and constructed to contact the second cam, and a locking device arranged and constructed to detachably connect the crosspiece to the supported portion, the locking device being disposed within the inner lever, wherein the first end second abutment surfaces are arranged and constructed such that;

(i) when the locking device connects the crosspiece to the supported portion, contact of the first abutment surface and the first cam will cause the valve to reciprocally move between a valve closed position and a fully open valve position, and (ii) when the locking device disconnects the crosspiece from th supported portion, contact of the second abutment surface and the second cam will cause the valve to reciprocally move between the valve closed position and a partially open valve position.

25. An apparatus according to claim 24, further comprising:

the camshaft, in operable contact with the first or second abutment surface, he hydraulic play-compensating element supporting the supported portion, at least one spring disposed between the inner lever and the outer lever, which at least one spring is arranged and constructed to bias the, outer lever towards the camshaft, a pin extending through the arms of the inner lever and the outer lever and pivotably coupling the respective hinge portions of the inner and outer levers, and wherein the locking device comprises a piston/cylinder unit that is actuatable by hydraulic fluid pressure supplied from the play-compensating element, the locking device further comprising a locking pin that is slidably movable into and out of an opening defined in the crosspiece of the outer lever, the inner lever comprises two arms that extend towards the valve, wherein the second abutment surface is defined by a roller mounted between the arms of the inner lever, and the second abutment surface is defined between the crosspiece and the pivotably coupled hinge portions of the inner and outer levers.

* * * * *